US007748695B2

(12) United States Patent
Miura et al.

(10) Patent No.: US 7,748,695 B2
(45) Date of Patent: Jul. 6, 2010

(54) IMAGE FORMING APPARATUS

(75) Inventors: Yohei Miura, Tokyo (JP); Joh Ebara, Kanagawa (JP); Takuya Uehara, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 317 days.

(21) Appl. No.: 12/068,810

(22) Filed: Feb. 12, 2008

(65) Prior Publication Data

US 2008/0211176 A1 Sep. 4, 2008

(30) Foreign Application Priority Data

Mar. 1, 2007 (JP) ..... 2007-052086
Jun. 29, 2007 (JP) ..... 2007-173185

(51) Int. Cl.
*B65H 5/00* (2006.01)

(52) U.S. Cl. ..... 271/10.13; 271/10.04; 271/10.12

(58) Field of Classification Search ..... 271/4.1, 271/10.01–10.04, 10.11–10.13, 114, 242
See application file for complete search history.

(56) References Cited

U.S. PATENT DOCUMENTS 5,755,435 A * 5/1998 Fujiwara ..... 271/4.04
5,793,399 A * 8/1998 Kawakami et al. ..... 347/104
5,971,386 A * 10/1999 Jean et al. ..... 271/4.08
6,601,843 B2 * 8/2003 Miki ..... 271/10.13
6,608,991 B2 * 8/2003 Takada ..... 399/394
6,641,130 B2 * 11/2003 Lee et al. ..... 271/10.04
6,837,489 B2 * 1/2005 Kim ..... 271/3.14
6,962,332 B2 * 11/2005 Su ..... 271/4.01
7,540,485 B2 * 6/2009 Su et al. ..... 271/10.05

FOREIGN PATENT DOCUMENTS

| | | |
|---|---|---|
| JP | 07-266642 | 10/1995 |
| JP | 08-020450 | 1/1996 |
| JP | 2002-193462 | 7/2002 |
| JP | 2002-255377 | 9/2002 |
| JP | 2003-176045 | 6/2003 |

* cited by examiner

*Primary Examiner*—Patrick Mackey
*Assistant Examiner*—Jeremy Severson
(74) *Attorney, Agent, or Firm*—Harness, Dickey & Pierce, P.L.C.

(57) ABSTRACT

A common driving source transmits a drive force to a driving unit that drives a feeding unit and a conveying unit. The driving source is a motor that rotates in either of a normal direction and a reverse direction. The feeding unit includes a mechanical drive-blocking mechanism in its driving sequence. The conveying unit includes a two-system driving sequence and a mechanical drive-blocking mechanism in the driving sequence so as to rotate in one direction regardless of a rotating direction of the driving source. A reduction ratio of each driving sequence in the conveying unit is identical.

17 Claims, 13 Drawing Sheets

REVERSE ROTATION OF MOTOR

MOTOR 1: REVERSE ROTATION
MOTOR 2: NORMAL ROTATION

MOTOR 1: REVERSE ROTATION
MOTOR 2: REVERSE ROTATION

NORMAL ROTATION OF MOTOR

REVERSE ROTATION OF MOTOR

IMAGE FORMING APPARATUS

CROSS-REFERENCE TO RELATED APPLICATIONS

The present application claims priority to and incorporates by reference the entire contents of Japanese priority documents 2007-052086 filed in Japan on Mar. 1, 2007 and 2007-173185 filed in Japan on Jun. 29, 2007.

BACKGROUND OF THE INVENTION

1. Field of the Invention

The present invention relates to an image forming apparatus like a copying machine, a printer, a fax machine, or a plotter, each of which has a sheet feeding device.

2. Description of the Related Art

A sheet feeding device, with which a conventional image forming apparatus is equipped, has generally includes a sheet feeding roller that feeds a sheet from a sheet feeding tray, and a conveying roller that is located at a downstream of the sheet feeding roller and conveys the sheet to a registration roller. As a driving unit, one motor has driven a plurality of motors such as the sheet feeding roller, the conveying roller.

At this time, in a conventional technology, a method has been generally proposed where turning on and off an electromagnetic clutch makes each roller perform a different motion to maintain a sheet conveying ability like a control between the sheets, prevention of feeding the sheets while superimposing the sheets, or a jam. The conventional technology has been disclosed, for example, in Japanese Patent Application Laid-open No. 2003-176045 (hereinafter, "Patent document 1") and in Japanese Patent No. 3782721 (hereinafter, "Patent document 2").

In Patent document 1, the sheet feeding roller and the conveying roller receive a driving force from the same motor to control a timing of turning on and off each electromagnetic clutch thereof, thereby obtaining the sheet conveying ability.

However, a decline of durability causes many defects where a slide occurs in the electromagnetic clutch, whereby the jam occurs. When a periodic replacement part is removed, a part, which has the highest frequency to be replaced in a market, is the electromagnetic clutch. As a result, a sheet convey, which has depended on turning on and off the electromagnetic clutch, has been configured to lack in reliability.

To solve the problem, Patent document 2 has been proposed the sheet feeding device having employed feed and reverse roller (FRR) (friction separation) method where normal and reverse rotations of the motor are combined with a one-way clutch, whereby the sheet convey is performed without depending on the electromagnetic clutch.

Specifically, the sheet feeding device, which has the sheet feeding roller, the conveying roller, and one motor that drives the rollers at each sheet-feeding stage, is configured in such a manner that the sheet feeding roller and the conveying roller drive in a direction of feeding the sheet when the motor rotates normally, and the conveying roller drives in the direction of feeding the sheet when the motor rotates reversely. At that time, a reverse roller drives in synchronization with the conveying roller.

However, in the technique disclosed in Patent document 2, a reduction ratio of a driving sequence at the time of normal rotation of the conveying roller has been different from the reduction ratio of the driving sequence at the time of reverse rotation of the conveying roller. Therefore, even at a same conveying speed, the motor must have been driven by use of a different pulse at the time of normal rotation compared with the time of reverse rotation, thereby leading to complication of a control table. When the motor is driven by use of the different pulse, a minute speed difference between the time of normal rotation and the time of reverse rotation occurs, thereby resulting in a configuration to cause the sheet conveying ability to be worsened.

SUMMARY OF THE INVENTION

It is an object of the present invention to at least partially solve the problems in the conventional technology.

According to an aspect of the present invention, there is provided an image forming apparatus including an image forming unit that forms a toner image on a photosensitive element; a transfer unit that transfers the toner image formed on the photosensitive element onto a recording medium; a fixing unit that fixes the toner image transferred onto the recording medium; a feeding unit that feeds the recording medium one by one; a conveying unit that is provided at a downstream side of the feeding unit and that conveys the recording medium to the transfer unit; a registration unit that is provided at a downstream side of the conveying unit and that changes a timing at which the recording medium is fed to the transfer unit; a driving unit that drives the feeding unit, the conveying unit, and the registration unit; and a common driving source that transmits a drive force to the driving unit that drives the feeding unit and the conveying unit. The driving source is a motor that rotates in either of a normal direction and a reverse direction. The feeding unit includes a mechanical drive-blocking mechanism in its driving sequence. The conveying unit includes a two-system driving sequence and a mechanical drive-blocking mechanism in the driving sequence so as to rotate in one direction regardless of a rotating direction of the driving source. A reduction ratio of each driving sequence in the conveying unit is identical.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
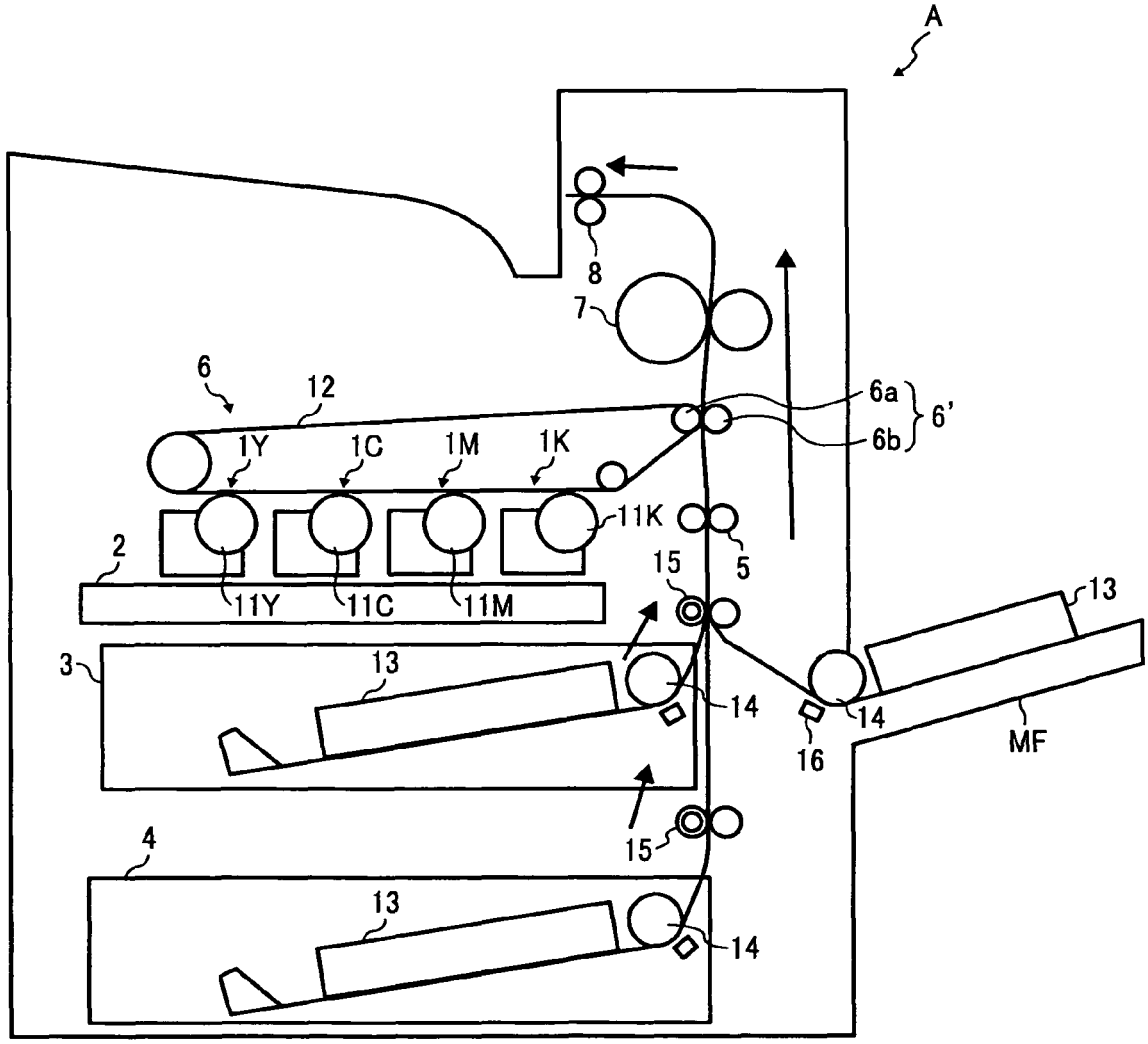
FIG. 1 is a schematic configuration view of laser printer according to an embodiment of an image forming apparatus of the present invention.
Figure 2:
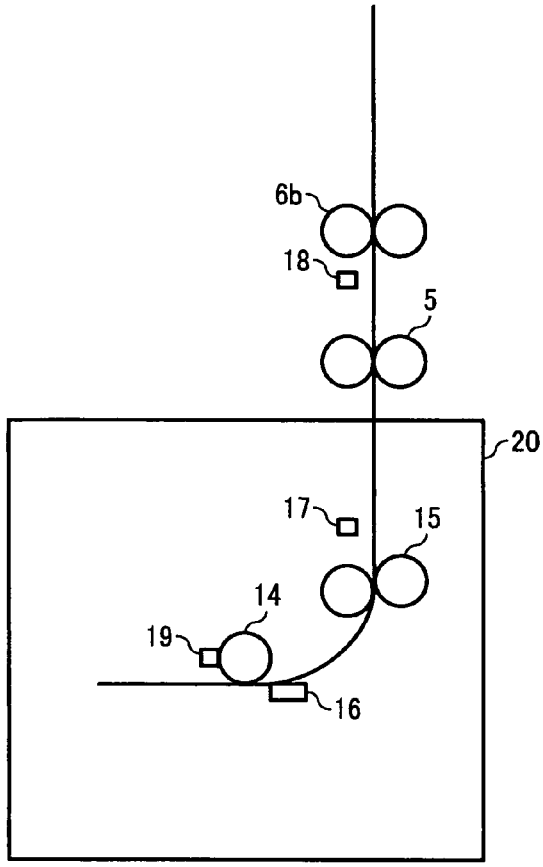
FIG. 2 is a schematic configuration view of a sheet feeding device that is used in the laser printer in FIG. 1.

With reference to the drawings, the present invention will be explained in detail. FIG. 1 is a schematic configuration view of a laser printer according to an embodiment of an image forming apparatus of the present invention. FIG. 2 is a schematic configuration view of a sheet feeding device that is used in the laser printer in FIG. 1.

With reference to FIGS. 1 and 2, one embodiment that has applied the present invention to a color laser printer (hereinafter, "laser printer"), which is the image forming apparatus, having employed a direct transfer method of an electrophotographic method will be explained.

In FIG. 1, a laser printer A forms an image in each color of Yellow (Y), Magenta (M), Cyan (C), and Black (K). Therefore, four groups of toner-image forming units 1Y, 1C, 1M, and 1K (hereinafter, an additional character Y, C, M, and K of each reference numeral indicates a member for yellow, magenta, cyan, and black, respectively) are arranged.

The toner-image forming units 1Y, 1C, 1M, and 1K include photosensitive element drums 11Y, 11C, 11M, and 11K serving as image supporters, respectively. And also, each of the toner-image forming units 1Y, 1C, 1M, and 1K includes a developing unit. At an upper side of the toner-image forming units 1Y, 1C, 1M, and 1K, an intermediate transfer unit 6, which conveys formed toner images while superimposing the images, is provided.

The laser printer A includes an optical writing unit 2, sheet feeding cassettes 3 and 4, a pair of registration rollers 5, in addition to the toner-image forming units 1Y, 1C, 1M, and 1K.

The laser printer A includes a driving roller 6*a* of an intermediate transfer belt 12 that configures the transfer unit 6, a second transfer roller 6*b*, which is located at a position opposite to the driving roller 6*a*, in a second transfer unit, a fixing unit 7 having employed a belt fixing method or the like. The laser printer A includes a manual sheet-feeding tray MF.

The optical writing unit 2 includes a light source, a polygon mirror, a f-θ lens, a reflective mirror or the like, all of which are not shown, and irradiates a surface of each photosensitive element drum 11Y, 11C, 11M, and 11K based on image data while performing a scanning.

An arrow in FIG. 1 indicates a convey path of a transfer sheet 13. A sheet feeding roller 14 feeds the transfer sheet 13 from the sheet feeding cassettes 3 and 4 or from the manual sheet-feeding tray MF. Then, a conveying roller 15 conveys the transfer sheet 13, while a transfer guide, which is not shown, guides the transfer sheet 13, to a pause position where the registration rollers 5 are provided.

After the transfer sheet 13 has paused in a state where a surface waviness is present between the conveying roller 15 and the registration rollers 5, the registration rollers 5 convey the transfer sheet 13 at a predetermined timing. On the surface of the conveyed transfer sheet 13, the toner image formed on the intermediate transfer belt 12 is under an effect from a transfer electric field or a nip pressure of the second transfer roller 6*b* to be formed as a full-color toner image.

The transfer sheet 13 where the full-color toner image has been formed, after the fixing unit 7 has fixed the full-color toner image, passes through an ejection roller 8. Then, the transfer sheet 13 is ejected outside the laser printer A that is the image forming apparatus.

As described above, the laser printer A, which is the image forming apparatus, is configured as a four-drum tandem full-color image forming apparatus.

A structure of the four-drum tandem full-color is capable of providing the image forming apparatus having high productivity and stable image quality.

A feature of the embodiment of a sheet feeding device 20 will be explained. As shown in FIG. 2, the sheet feeding device 20 includes the sheet feeding roller 14 that sends the stacked sheet 13 (FIG. 1), a friction pad 16 that is provided to prevent the sheet 13 from being fed while being superimposed.

When a separating mechanism is provided at the sheet feeding roller 14 that is a sheet feeding unit that sends the stacked sheet 13, and the separating mechanism employs a friction pad method, it is possible to resolve a defect such as feeding the sheets while superimposing the sheets at the lowest cost, to improve a separation ability, and to provide stable sheet transfer quality.

The sheet feeding device 20 includes the conveying roller 15 and a sensor class (vertical transfer sensor 17) that detects a transfer position of the sheet 13, both of which are provided at a downstream of the sheet feeding roller 14. FIG. 2 further shows the registration rollers 5, the second transfer roller 6*b*, a resist sensor 18, and a sheet feeding sensor 19.

Figure 3:
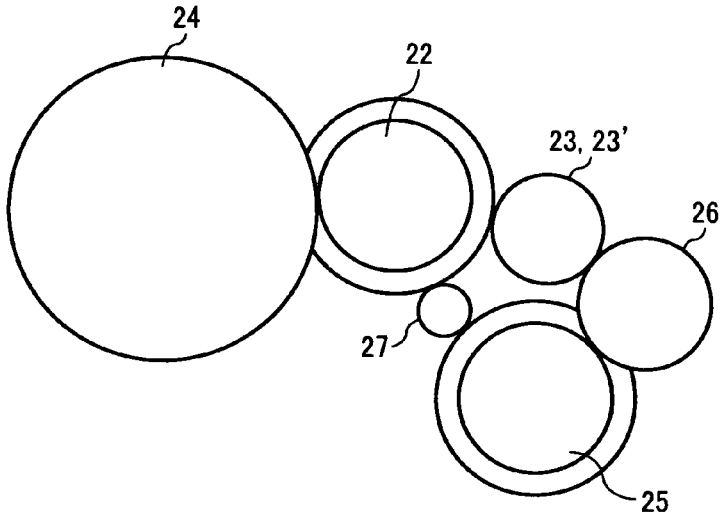
FIG. 3 is a schematic front view of the sheet-feeding driving unit that drives the sheet feeding device shown in FIG. 2.
Figure 4:
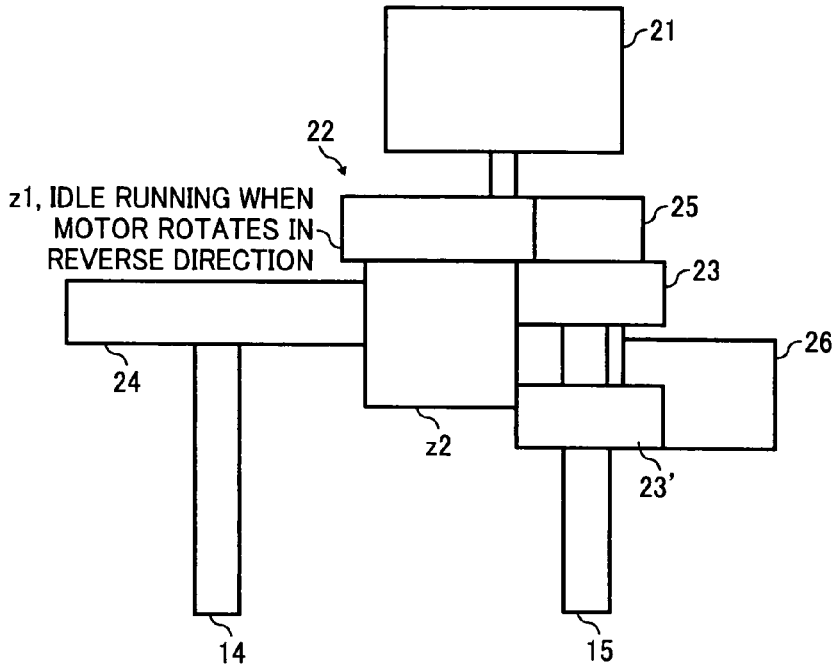
FIG. 4 is a schematic plan view of the sheet-feeding driving unit that drives the sheet feeding device shown in FIG. 2.

FIG. 3 is a schematic front view of a sheet-feeding driving unit that drives the sheet feeding device. FIG. 4 is a schematic plan view of the sheet-feeding driving unit that drives the sheet feeding device. In FIGS. 3 and 4, a motor 21, which is a driving source, is provided so as to rotate the sheet feeding roller 14 and the conveying roller 15 via a motor gear 27 (output unit of the driving source) of the motor 21, although components shown in FIGS. 3 and 4 do not necessarily correspond to, respectively, for easily understanding. Strictly speaking, the numeral references 14, 15 indicate axes that directly connect with the sheet feeding roller 14 and the conveying roller 15, respectively. However, an explanation will be given on the assumption that the numeral references 14, 15 indicate the sheet feeding roller and the conveying roller, respectively, for convenience sake.

In this case, when the motor (sheet feeding and conveying motor) 21, which serves as a driving unit that drives the sheet feeding roller 14 that is the sheet feeding unit and the conveying roller 15 that is a conveying unit, is a permanent magnet (PM) type stepping motor, reduction of costs is allowed.

In a driving sequence (gear, one-way clutch) that drives the sheet feeding roller 14, a first gear 24, and a sheet feeding one-way clutch 22 that includes a gear z1 and a gear z2 are arranged.

In two-system driving sequences (gear, one-way clutch) that drive the conveying roller 15, two conveying one-way clutches (a first and a second conveying one-way clutches 23, 23') are arranged on the same axis of the conveying roller 15. That is, the axis of the conveying roller 15 supports a center of the axis of the first and the second conveying one-way clutches 23, 23' that are concentrically arranged. A second gear 25 and a third gear 26 are arranged at a side of the conveying roller 15.

Each of the structures of the sheet feeding one-way clutches 22, 23, and 23' employs a method that a spring regulates. Because the method itself has been widely general, a detail explanation will be omitted here. When the one-way clutch employs a mechanical drive-blocking mechanism, a changeover of the driving is unfailingly allowed at the lowest cost.

When the gear of the sheet feeding one-way clutch 22, which engages with the motor gear 27 of a motor axis, is z1, and the gear, which engages with the first gear 24, is z2, an incorporated spring (not shown) becomes in a winding direction at the time of normal rotation of the motor, thereby transmitting a driving force to the gear z1 or to the gear z2.

At the time of reverse rotation of the motor, the spring becomes in a loose direction, whereby only the gear z1 becomes in a state of idle running. The number of teeth of the sheet feeding one-way clutch 22 is made same as the number of teeth of the second gear 25, whereby gear ratios of two-system gear arrays of the conveying roller 15 become same. FIG. 3 also shows the third gear 26.

Figure 5:
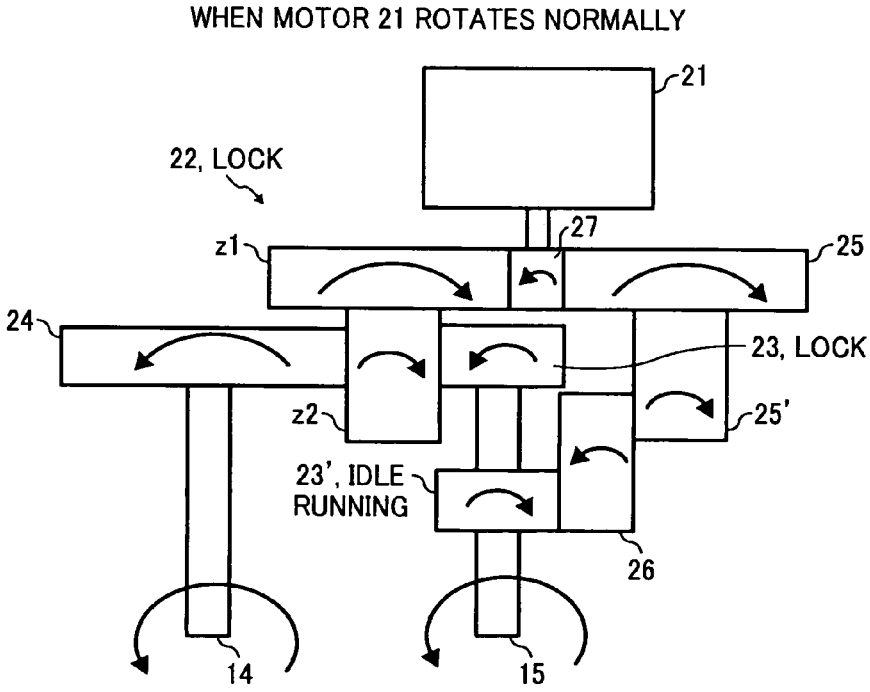
FIG. 5 is a schematic view of the sheet-feeding driving unit that drives the sheet feeding device shown in FIG. 2, when a motor rotates normally.
Figure 6:
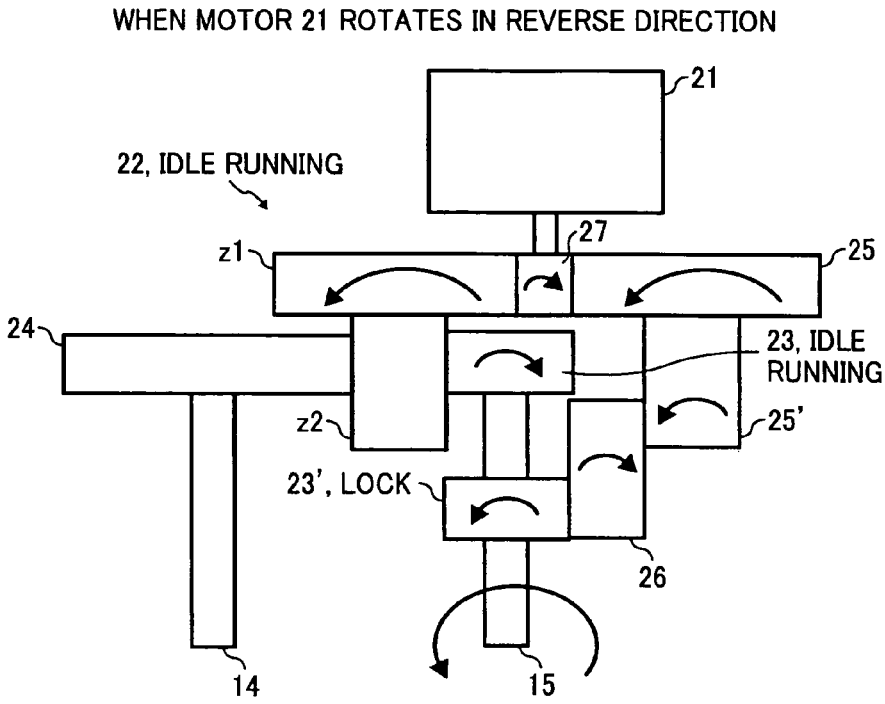
FIG. 6 is a schematic view of the sheet-feeding driving unit that drives the sheet feeding device shown in FIG. 2, when the motor rotates reversely.

FIG. 5 is a schematic view of the sheet-feeding driving unit that drives the sheet feeding device at the time of normal rotation of the motor, which is schematically depicted in such a manner that overlapping of the gears in FIG. 4 can be easily viewed, for simplifying an explanation. FIG. 6 is a schematic view of the sheet-feeding driving unit that drives the sheet feeding device at the time of reverse rotation of the motor, which is schematically depicted in such a manner that the overlapping of the gears in FIG. 4 can be easily viewed, for simplifying an explanation.

Each of FIGS. 5 and 6 shows the sheet feeding roller (axis) 14, the conveying roller (axis) 15, the motor 21 that is the driving source, the sheet feeding one-way clutch 22, the first and the second conveying one-way clutches 23, 23', the first gear 24, the second gear 25, the third gear 26, and a fourth gear 25'. Further, each of FIGS. 5 and 6 shows the motor gear (output unit) 27 that has been mounted on the motor 21, and the gears z1, z2 of the sheet feeding one-way clutch 22.

In FIG. 5, at the time of normal rotation of the motor (sheet feeding, conveying motor) 21 that is the driving source, the sheet feeding one-way clutch 22 becomes in a locking direction to transmit the driving force to the sheet feeding roller 14. The first conveying one-way clutch 23 of the conveying roller 15, which engages with the gear z2 that is a small gear unit protruding downwardly at a central portion of the gear z1 of the sheet feeding one-way clutch 22, becomes in the locking direction, thereby driving the conveying roller 15. During this time, the second conveying one-way clutch 23', which the axis of the conveying roller 15 supports, continues the idle running.

In FIG. 6, at the time of reverse rotation of the motor 21, the sheet feeding one-way clutch 22 and the first conveying one-way clutch 23 perform the idle running. In this case, the second gear 25 and the third gear 26 make the second conveying one-way clutch 23' in the locking direction, thereby transmitting the driving force only to the conveying roller 15.

In a motion of the sheet feeding device in the actual image forming apparatus, the sheet feeding device normally drives the motor 21 at the same time as a start of printing, and then, when the sensor detects that a tip of the sheet will reach a resist nip, the sheet feeding device stops the motor 21. After having stopped the motor 21 for a predetermined period of time, the sheet feeding device, being synchronized with the drive of the registration roller 5 (FIG. 2), performs the reverse rotation drive of the motor 21 to drive only the conveying roller 15 (FIG. 6), so as not to feed the next sheet.

A position, where the one-way clutch is arranged, will be explained. As shown in FIGS. 5 and 6, when the sheet feeding one-way clutch 22 is arranged so as to engage with the motor gear 27, the second gear 25, which is located at the subsequent downstream, becomes capable of keeping a stopped state at the time of idle running of the sheet feeding one-way clutch 22. As a result, it is possible to reduce required torque of the motor 21 and current value, and additionally, it is advantageous for a lifetime of the gear.

When a sheet (paper) size is long, after the tip of the sheet has reached the resist nip, the sheet feeding roller 14 may nip a rear end of the sheet. At this time, when the motor 21 is rotated in the reverse direction to rotate the conveying roller 15, the sheet feeding roller 14 (FIG. 3) rotates due to a friction generated from the sheet and the surface of the sheet feeding roller 14. This may result in rotating the first gear 24 normally, thereby transmitting the driving force to the conveying roller 15 from the two-system.

Therefore, when the sheet feeding roller 14 nips the rear end of the sheet, even after the tip of the sheet has reached the resist nip, because the sheet size is long, it is preferable to arrange the one-way clutch at a final tier (end of the rotating axis) of the sheet feeding roller 14.

Figure 7:
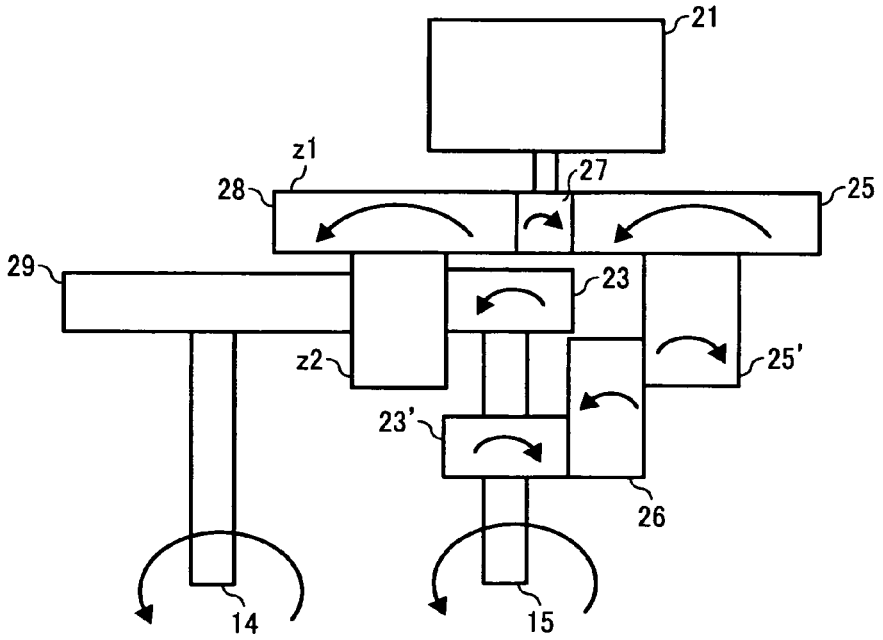
FIG. 7 is a schematic view of the sheet-feeding driving unit that drives the sheet feeding device shown in FIG. 2, when the motor rotates normally.
Figure 8:
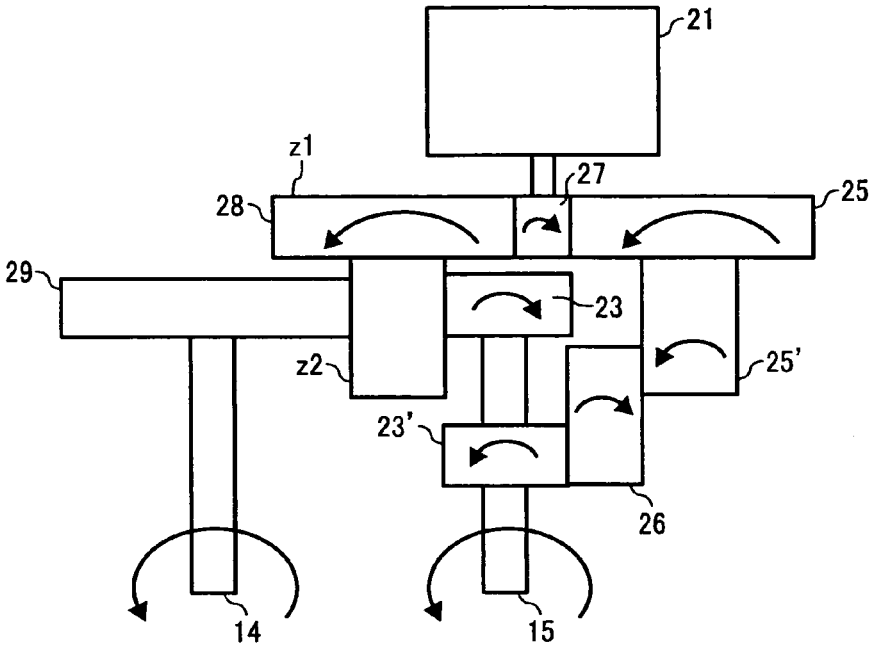
FIG. 8 is a schematic view of the sheet-feeding driving unit that drives the sheet feeding device shown in FIG. 2, when the motor rotates reversely.

FIG. 7 is a schematic view of the sheet-feeding driving unit that drives the sheet feeding device at the time of normal rotation of the motor, which is schematically depicted in such a manner that the overlapping of the gears in FIG. 4 can be easily viewed, for simplifying an explanation. FIG. 8 is a schematic view of the sheet-feeding driving unit that drives the sheet feeding device at the time of reverse rotation of the motor, which is schematically depicted in such a manner that the overlapping of the gears in FIG. 4 can be easily viewed, for simplifying an explanation.

Each of FIGS. 7 and 8 shows the sheet feeding roller 14, the conveying roller 15, the motor 21 that is the driving source, a first and a second sheet feeding one-way clutches 28, 29, the first and the second conveying one-way clutches 23, 23', the second gear 25, the third gear 26, and the fourth gear 25'. Further, each of FIGS. 7 and 8 shows the motor gear (output unit) 27 which has been mounted on the motor 21, and the gears z1, z2 of the first sheet feeding one-way clutch 28.

The first sheet feeding one-way clutch 28 is arranged at a first tier in the driving sequence of the sheet feeding roller 14. The second sheet feeding one-way clutch 29 is arranged at the final tier in the driving sequence of the sheet feeding roller 14. At the two-system driving sequences that drive the conveying roller 15, the first and the second conveying one-way clutches 23, 23' are arranged on the same axis of the conveying roller 15.

As shown in FIGS. 7 and 8, when the one-way clutches 28 and 29 are arranged at the first tier and the final tier, respectively, in the driving sequence for the sheet feeding roller 14, the sheet is prevented from transmitting the drive, and it is advantageous also for the lifetime of the gear during reverse rotation.

The motor gear 27, which directly connects with an output axis of the motor 21, engages with the driving sequence having the mechanical drive-blocking mechanism (one-way clutch), whereby load torque can be reduced. The final tier of the sheet feeding unit (sheet feeding roller) 14 is made be the driving sequence having the mechanical drive-blocking mechanism, whereby the drive via the sheet can be prevented from being transmitted.

At least one of mechanical drive-blocking mechanisms (one-way clutch) 28, 29, 23, and 23' in the driving sequences of the sheet feeding roller 14 and of the conveying roller 15 is arranged at a position that directly connects with the motor gear 27 of the driving source (motor) 21. As a result, because the driving sequence except the driving sequence relating to the mechanical drive-blocking mechanism (one-way clutch) is in the stopped state, reduction of unnecessary load, which is put on the motor 21, and of the current value is enabled at low cost.

In the sheet feeding device that feeds the long sheet, the mechanical drive-blocking mechanism 29 is arranged at the final tier of the sheet feeding unit (sheet feeding roller) 14, whereby the drive from the sheet can be prevented from being transmitted.

Figure 9:
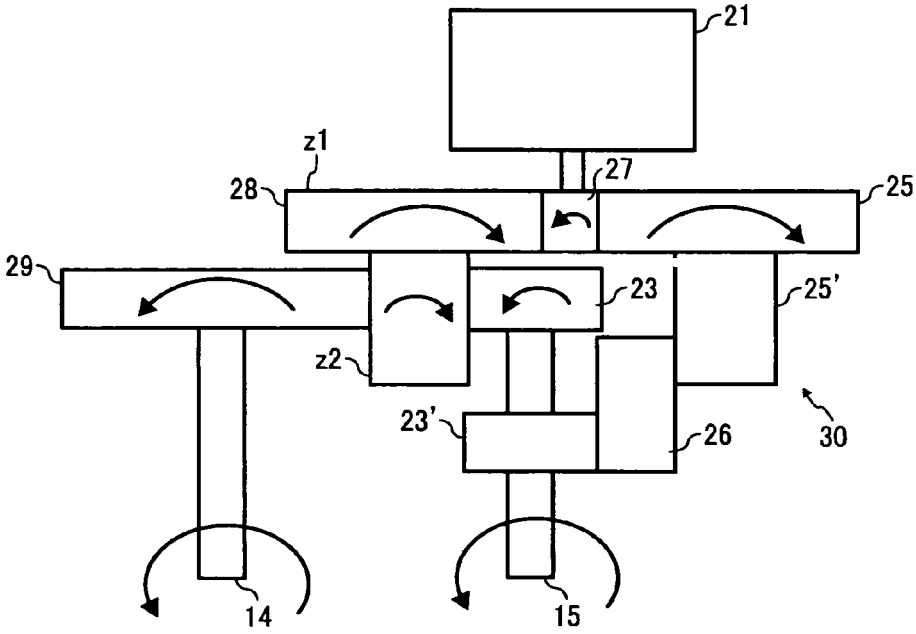
FIG. 9 is a schematic view of the sheet-feeding driving unit that drives the sheet feeding device shown in FIG. 2, when the motor rotates normally.
Figure 10:
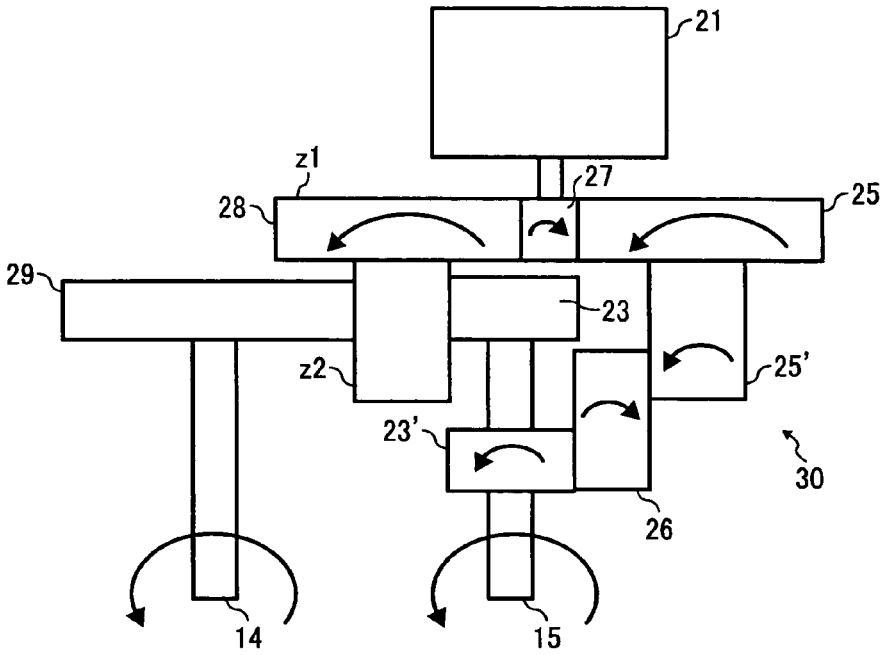
FIG. 10 is a schematic view of the sheet-feeding driving unit that drives the sheet feeding device shown in FIG. 2, when the motor rotates reversely.

FIG. 9 is a schematic view of the sheet-feeding driving unit that drives the sheet feeding device at the time of normal rotation of the motor, which is schematically depicted in such a manner that the overlapping of the gears in FIG. 4 can be easily viewed, for simplifying an explanation. FIG. 10 is a schematic view of the sheet-feeding driving unit that drives the sheet feeding device at the time of reverse rotation of the motor, which is schematically depicted in such a manner that the overlapping of the gears in FIG. 4 can be easily viewed, for simplifying an explanation.

Each of FIGS. 9 and 10 shows the sheet feeding roller 14, the conveying roller 15, the motor 21 that is the driving source, the first and the second sheet feeding one-way clutches 28, 29, and the first, the second, and a third conveying one-way clutches 23, 23', and 30.

Further, each of FIGS. 9 and 10 shows the motor gear 27 that has been mounted on the motor 21, the gears z1, z2 of the first sheet feeding one-way clutch 28, the third gear 26, and the second gear 25 and the fourth gear 25' of the third conveying one-way clutch 30.

The first sheet feeding one-way clutch 28 is arranged at the first tier in the driving sequence of the sheet feeding roller 14. The second sheet feeding one-way clutch 29 is arranged at the final tier in the driving sequence of the sheet feeding roller 14.

At the two-system driving sequences that drive the conveying roller 15, the first conveying one-way clutch 23 and the second conveying one-way clutch 23' are arranged on the same axis of the conveying roller 15.

Also at the first tier in the driving sequence of the conveying roller 15, the third conveying one-way clutch 30 is arranged.

As described above, each of the driving sequences, which engage with the motor 21, is made be the driving sequence having the mechanical drive-blocking mechanism (one-way clutch), whereby reduction of the load torque, which is the most necessary torque for the driving source (motor), becomes allowed.

As shown in FIGS. 9 and 10, when the one-way clutch 30 is arranged also at the first tier of the conveying roller 15, it is also advantageous for further reducing the required torque of the motor, the current value, and for the lifetime of the gear array located at the downstream.

Figure 11:
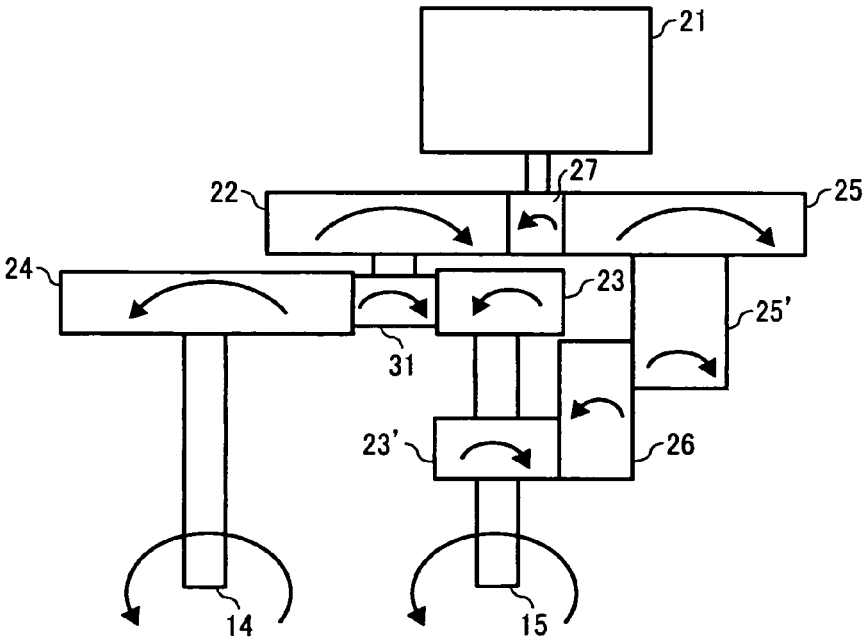
FIG. 11 is a schematic view of the sheet-feeding driving unit that drives the sheet feeding device shown in FIG. 2, when the motor rotates normally.
Figure 12:
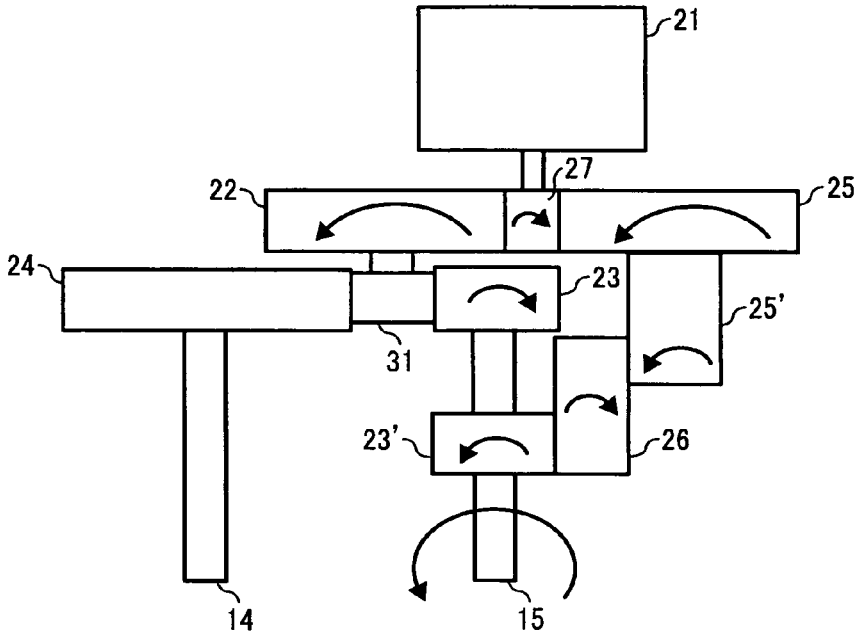
FIG. 12 is a schematic view of the sheet-feeding driving unit that drives the sheet feeding device shown in FIG. 2, when the motor rotates reversely.

FIG. 11 is a schematic view of the sheet-feeding driving unit that drives the sheet feeding device at the time of normal rotation of the motor, which is schematically depicted in such a manner that the overlapping of the gears in FIG. 4 can be easily viewed, for simplifying an explanation. FIG. 12 is a schematic view of the sheet-feeding driving unit that drives the sheet feeding device at the time of reverse rotation of the motor, which is schematically depicted in such a manner that the overlapping of the gears in FIG. 4 can be easily viewed, for simplifying an explanation.

Each of FIGS. 11 and 12 shows a configuration where a gear 31 is arranged on the same axis of the sheet feeding one-way clutch 22. Each of FIGS. 11 and 12 shows the sheet feeding roller 14, the conveying roller 15, the motor 21 that is the driving source, the sheet feeding one-way clutch 22, and the first and the second conveying one-way clutches 23, 23'. Further, Each of FIGS. 11 and 12 shows the motor gear 27 that has been mounted on the motor 21, the second gear 25, the fourth gear 25', and the third gear 26.

It makes no difference whether the mechanical drive-blocking mechanism is the one-way clutch having employed spring method or the one-way clutch having employed needle method. When the one-way clutch by use of the needle method is employed, as shown in FIGS. 11 and 12, the gear 31, which is connected with a driving shaft on the same axis of the sheet feeding one-way clutch 22, is arranged.

A sheet feeding from the manual sheet-feeding device (MF in FIG. 1) will be explained. As described above, a single motor, which is not shown, drives the sheet feeding roller 14 of the manual sheet-feeding device (tray) MF.

In a convey 1, which is located in the downstream, in FIGS. 13 and 14 that will be described later, as similar as shown in FIG. 6, the motor (sheet feeding, conveying motor) 21 drives the conveying roller 15.

As a result, during the manual sheet feeding, the motor 21, which drives the conveying roller 15 of the convey 1, performs a reverse drive at any time. Accordingly, the sheet, which has been fed from the manual sheet-feeding tray, is fed to the resist unit 5. When the motor, which is the driving source of the manual sheet-feeding device, is the PM type stepping motor, the reduction of costs becomes allowed.

In the manual sheet-feeding device, when compared with the sheet feeding from a body tray, an ability to respond to the sheet is required. Specifically, it is necessary to be capable of feeding a thick sheet. When the manual sheet-feeding device feeds the thick sheet, the load torques of the sheet feeding roller and of the conveying roller increase. As a result, when the same driving source drives the rollers, high torque is required of the motor that is the driving source, thereby leading to increase of cost.

According to the present invention, the reverse drive of the motor including the sheet feeding one-way clutch of a sheet feeding 1, which is the sheet feeding from the sheet feeding device 3 located at a first stage in the laser printer A in FIG. 1, drives the conveying roller 15, and a manual sheet-feeding motor, which is not shown, drives only the manual sheet-feeding roller, whereby the load torque, that is, a driving load is allowed to be diversified.

When the friction pad (the reference numeral is 16 in FIG. 1) is utilized as the separating mechanism in the sheet feeding device, the separation ability improves. There is no fear where addition of the motor increases the motor load like FRR.

As described above, the separating mechanism employs the friction pad, whereby sheet conveying quality can be kept at low cost and in a stable manner, and the defect, such as feeding the sheet while superimposing the sheet, can be resolved at the lowest cost.

Figure 13:
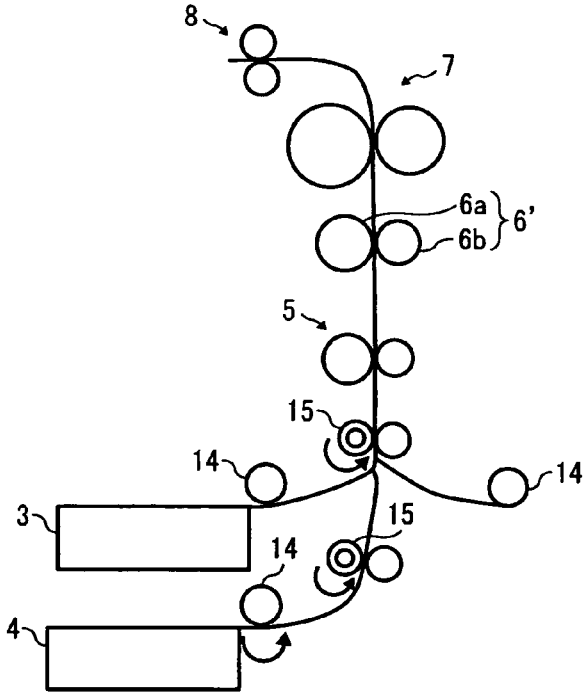
FIG. 13 is a schematic view that explains the embodiment of a convey path in the laser printer in FIG. 1 by use of a state before a sheet reaches a resist.

FIG. 13 is a schematic view that explains the embodiment of the convey path in the laser printer in FIG. 1 by use of a state before the sheet reaches the resist. FIG. 14 is a schematic view that explains the embodiment of the convey path in the laser printer in FIG. 1 by use of state after the sheet has reached the resist.

The sheet feeding from the sheet feeding device (the sheet feeding cassette 4 in FIG. 4) at a second stage of the laser printer A in FIG. 1 will be explained. Its driving structure is entirely same as the structure that has been explained in FIGS. 3 through 6. FIGS. 13 and 14 explain the sheet feeding, while defining the sheet feeding at the first stage (the sheet feeding cassette 3 at an upper side in FIG. 1) as the sheet feeding 1 and defining the driving motor thereof as a motor 1, and defining the sheet feeding at the second stage (the sheet feeding cassette 4 at a lower side in FIG. 1) as a sheet feeding 2 and defining the driving motor thereof as a motor 2.

Figure 14:
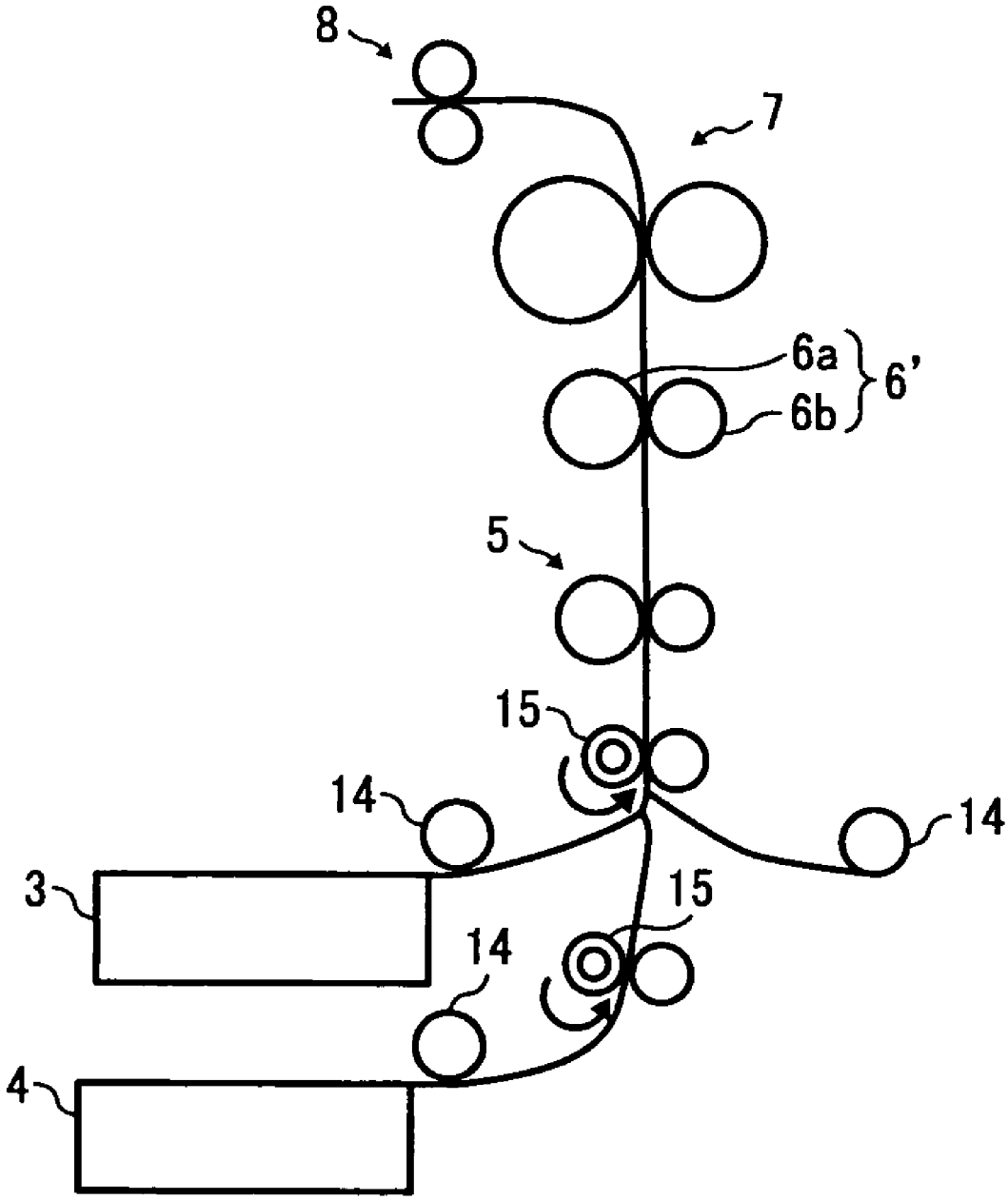
FIG. 14 is a schematic view that explains the embodiment of the convey path in the laser printer in FIG. 1 by use of a state after the sheet has reached the resist.

FIGS. 13 and 14 define the sheet feeding at the first stage (the sheet feeding cassette 3 at the upper side in FIG. 1) as the sheet feeding 1. The sheet feeding 1 includes the one-way clutch that is not shown, the motor 1, the sheet feeding roller 14, and the conveying roller 15. FIGS. 13 and 14 define the sheet feeding at the second stage (the sheet feeding cassette 4 at the lower side in FIG. 1) as the sheet feeding 2. Moreover, the sheet feeding 2 includes the one-way clutch that is not shown, the motor 2, the sheet feeding roller 14, and the conveying roller 15.

Each of FIGS. 13 and 14 further shows the sheet feeding roller 14 of the manual sheet-feeding device (tray) MF, the resist unit 5, the driving roller 6*a* of the intermediate transfer belt that configures the transfer unit, the second transfer roller 6*b*, which is located at the position opposite to the driving roller 6*a*, in a second transfer unit 6', the fixing unit 7, and the sheet ejecting unit 8.

Until the sheet reaches the resist nip, the motor 1 drives reversely, and the motor 2 drives normally (FIG. 13). When the sheet is fed to a second transfer nip in the second transfer unit 6' after having been reached the resist, each of the motors 1 and 2 rotates reversely (FIG. 14).

When the size of the sheet is small, if the rear end of the sheet passes through a sheet-feeding roller nip before the tip of the sheet reaches the resist nip, the defect of consecutive feeding of the sheets (two consecutive sheets are fed) occurs. In this case, after having rotated normally, the motor 2 once stops when the tip of the sheet is between the conveying roller 15 and the registration roller 5 to reversely rotate.

At this time, because reduction ratios of two-system of the conveying rollers in the convey 1 and a convey 2 are same, values of driving pulse per second (PPS) of the motors 1 and 2 are same at either timing. When the reduction ratio is different from each other, although the first and the second conveys have same conveyspeeds, each of the motors 1 and 2 must have a different driving pulse, thereby leading to complication of control.

When the reduction ratios are different from each other, because the driving pulses and the reduction ratios are different from each other, entirely same driving speeds can not be achieved, thereby adversely affecting the convey quality. According to the present invention, the problem can be resolved, and it is possible to drive with the same driving pulses and at the same conveyspeeds.

In this case, speeding up the conveyspeed until the sheet reaches resist results in increasing productivity and in improving the productivity of the image forming apparatus.

In the embodiment, because the number of rollers which each motor drives decreases, the load torque, which is put on the motor, lessens. As a result, it is advantageous to utilize the inexpensive PM type stepping motor having small size.

When the embodiment of the present invention is applied to the four-drum tandem full-color image forming apparatus, the image forming apparatus having high productivity and stable image quality can be provided.

Figure 15:
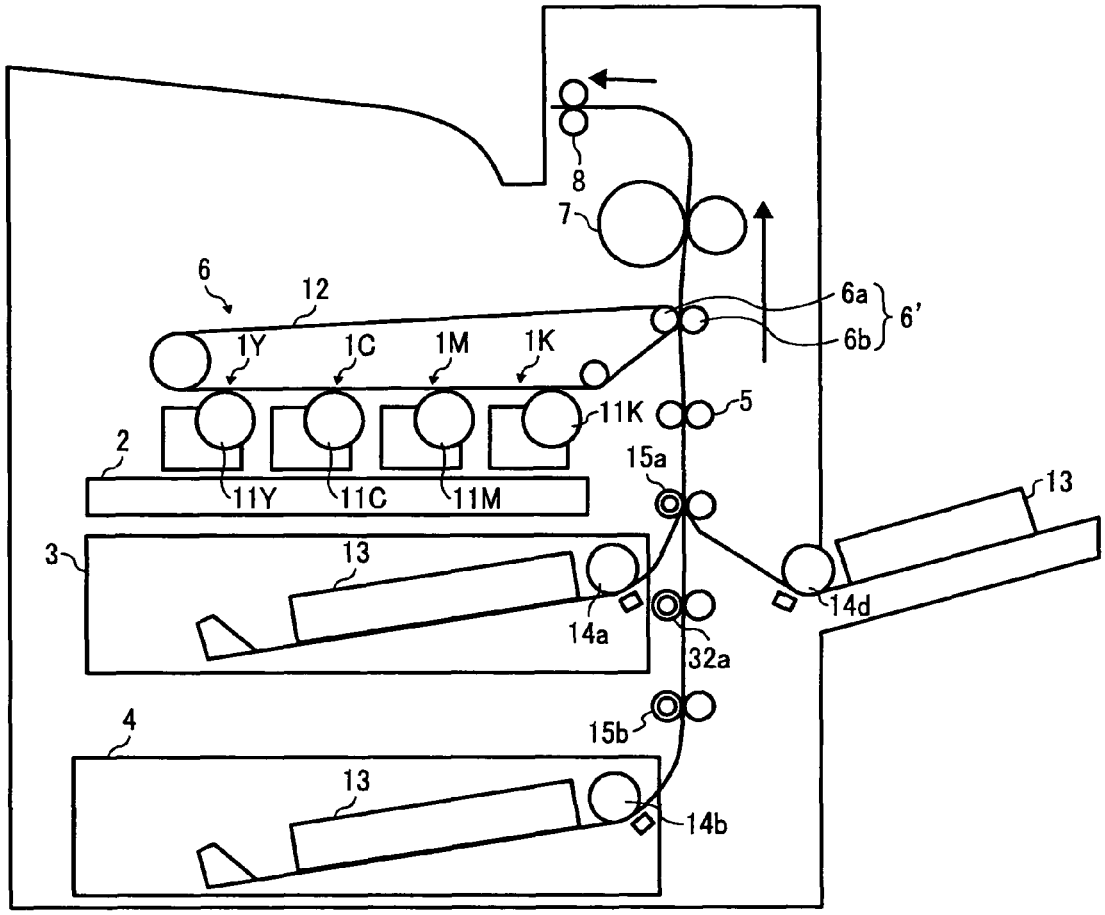
FIG. 15 is a schematic view of an image forming apparatus according to a second embodiment of the present invention.

A second embodiment according to the present invention will be explained. FIG. 15 is a schematic view of the image forming apparatus according to the second embodiment of the present invention. Because the fundamental structure itself is the same as the image forming apparatus shown in FIG. 1, the same numeral references are attached to the same portions, and an unnecessary explanation will be omitted here. In the image forming apparatus according to the second embodiment in FIG. 15, because a sheet feeding tray has large capacity, the convey path becomes longer.

Therefore, in addition to conveying rollers 15*a*, 15*b* that convey the sheet fed to the registration roller 5 from sheet feeding rollers 14*a*, 14*b* in sheet feeding stages, respectively, or from a sheet feeding roller 14*d* of the manual sheet-feeding tray MF, a relay conveying roller 32, which relays between the conveying roller 15*a* and 15*b*, is arranged. The driving source at the upper stage drives the relay conveying roller 32.

Figure 16:
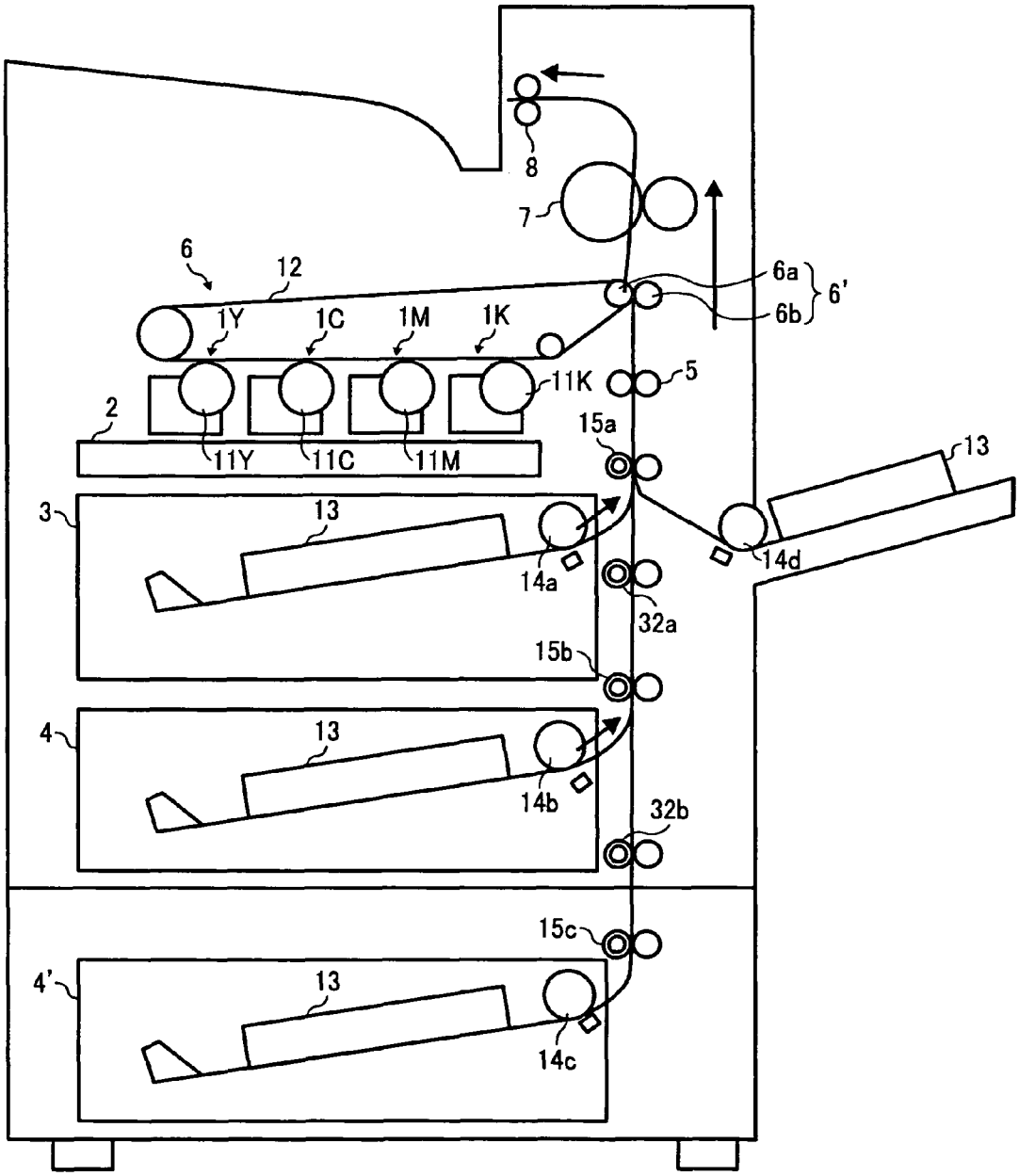
FIG. 16 is a schematic view of the image forming apparatus when an expanded tray has been mounted thereon in the second embodiment in FIG. 15.

FIG. 16 is a schematic view of the image forming apparatus when an expanded tray is mounted thereon, in the second embodiment in FIG. 15. Because the fundamental structure itself is the same as the image forming apparatus shown in FIG. 1, the same numeral references are attached to the same portions, and an unnecessary explanation will be omitted here.

As shown in FIG. 16, even when an expanded tray 4' is mounted thereon, a relay conveying roller 32*b*, which has received the driving force from the motor (not shown) that is the driving source of a second sheet-feeding stage, is arranged between a conveying roller 15*c* of the expanded tray 4' and the conveying roller 15*b* of the second sheet-feeding stage.

In FIG. 16, the sheet feeding roller in each stage is indicated as the reference numerals 14*a*, 14*b*, and 14*c*, respectively. The sheet feeding roller of the manual sheet-feeding tray MF is indicated as 14*d*. The conveying roller of each stage is indicated as 15*a*, 15*b*, and 15*c*, respectively. The relay conveying rollers are indicated as 32*a*, 32*b*.

Figure 17:
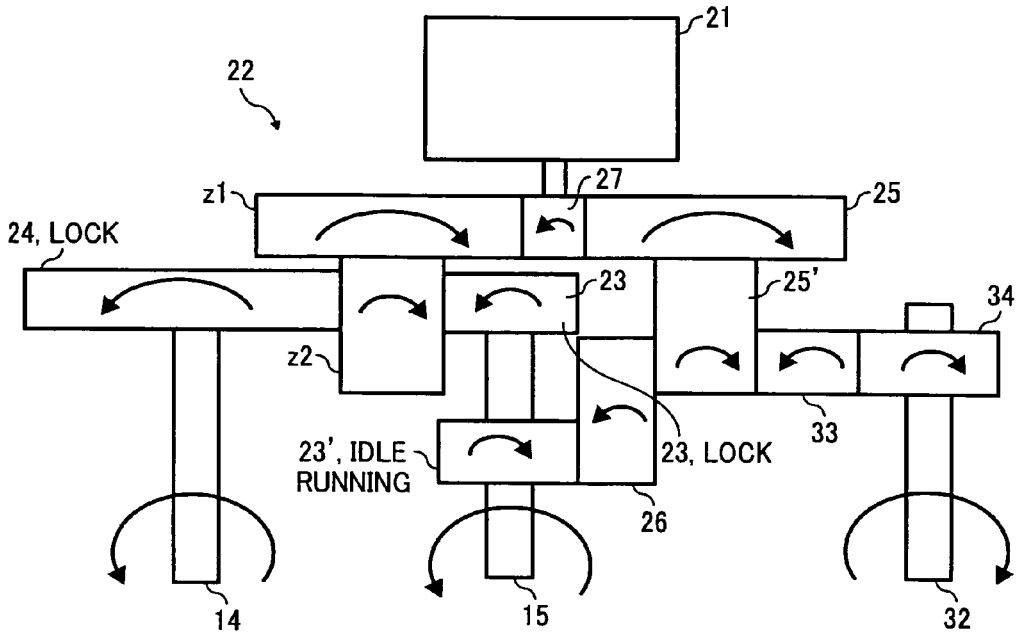
FIG. 17 is a schematic plan view of a sheet-feeding driving unit that drives a sheet feeding device, when a motor rotates normally, in the second embodiment in FIG. 15.
Figure 18:
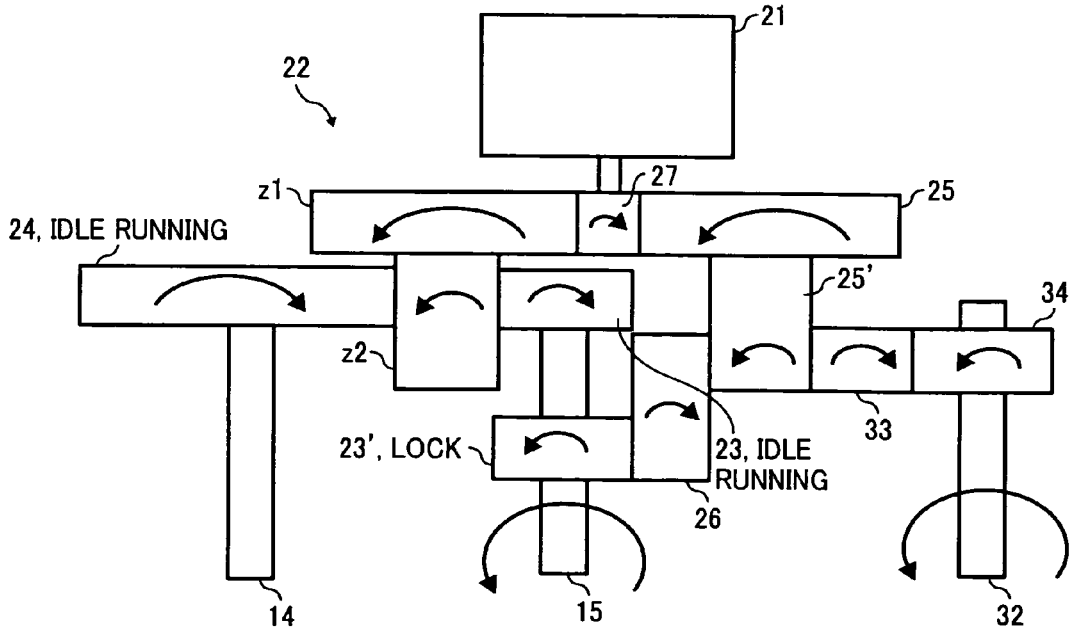
FIG. 18 is a schematic plan view of the sheet-feeding driving unit that drives the sheet feeding device, when the motor rotates reversely, in the second embodiment in FIG. 15.

FIG. 17 is a schematic plan view of the sheet-feeding driving unit that drives the sheet feeding device at the time of normal rotation of the motor in the second embodiment in FIG. 15. FIG. 18 is a schematic plan view of the sheet-feeding driving unit that drives the sheet feeding device at the time of reverse rotation of the motor in the second embodiment in FIG. 15.

In the sheet-feeding driving unit in FIGS. 17 and 18, the one-way clutch is incorporated in each of the gear 24 on the sheet feeding roller 14 and the gears 23, 23' on the conveying roller 15. The position, where the one-way clutch is arranged, is applicable to any of the driving sequence configurations shown in the first embodiment.

Figure 19:
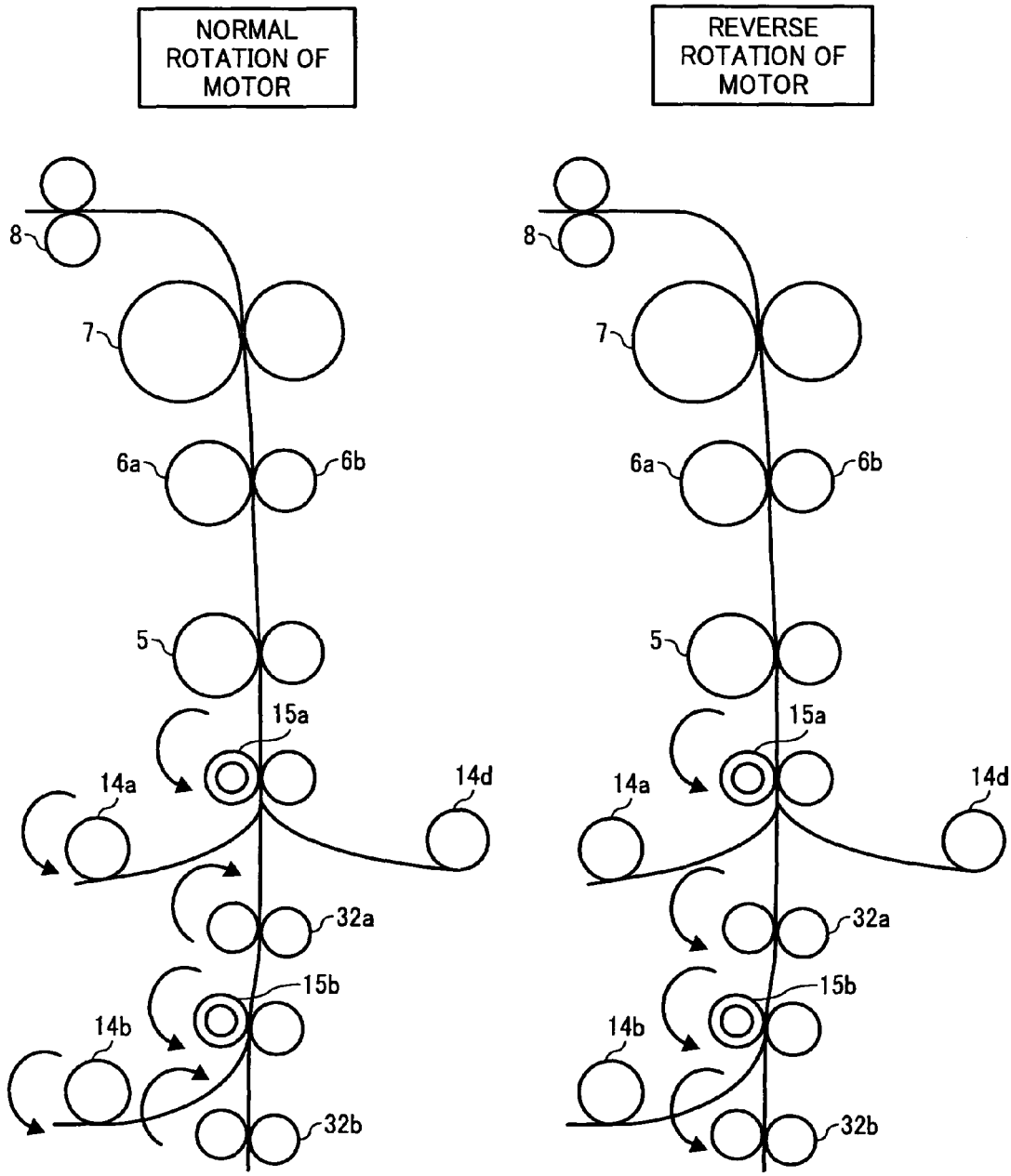
FIG. 19 is a schematic view that schematically depicts a rotation direction of each roller in the sheet-feeding driving unit at a convey path, when the motor is driven, in the second embodiment in FIG. 15.

FIG. 19 is a schematic view that schematically depicts a rotation direction of each roller in the sheet-feeding driving unit at the convey path, when the motor is driven, in the second embodiment in FIG. 15. FIG. 19 dose not show the one-way clutch. However, an arrangement of each roller is same as the arrangement in the image forming apparatus in FIG. 16. Therefore, the same numeral references are attached to the same portions, and an explanation on unnecessary configuration, motion will be omitted.

In FIGS. 17 to 19, gears 33, 34, which transmit the driving force to the relay conveying roller 32, are further positioned in the driving sequence of the conveying roller 15. When the motor rotates normally as shown in FIGS. 17 and 19, the sheet feeding rollers 14 (14*a*, 14*b*), the conveying rollers 15 (15*a*, 15*b*) drive in a sheet-conveying direction.

At this time, the relay conveying rollers 32 (32*a*, 32*b*) drive reversely relative to the sheet-conveying direction. On the other hand, when the motor rotates reversely as shown in FIGS. 18 and 19, the conveying rollers 15 (15*a*, 15*b*) and the relay conveying rollers 32 (32*a*, 32*b*) drive in the sheet-conveying direction.

As shown in FIG. 17, when the motor rotates normally, the relay conveying roller 32 rotates in a reverse direction relative to the sheet-conveying direction. However, at that time, because the sheet is not conveyed from the lower sheet feeding stage, any problem relating to the sheet convey dose not occur.

Figure 20:
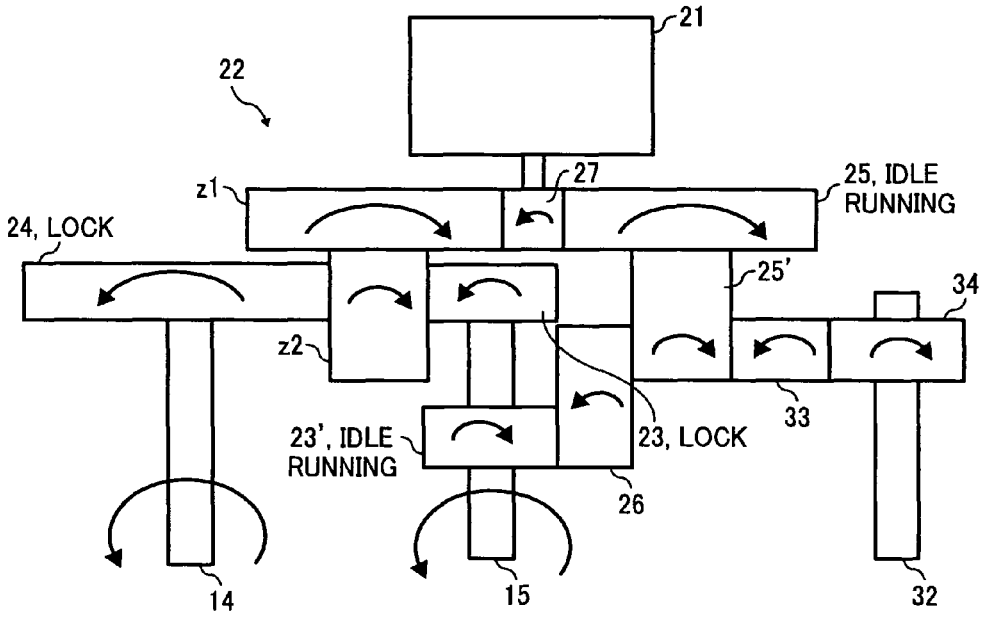
FIG. 20 is a schematic plan view of the sheet-feeding driving unit that drives the sheet feeding device equipped with a relay conveying unit having a mechanical drive-blocking mechanism in a driving sequence, when the motor rotates normally.
Figure 21:
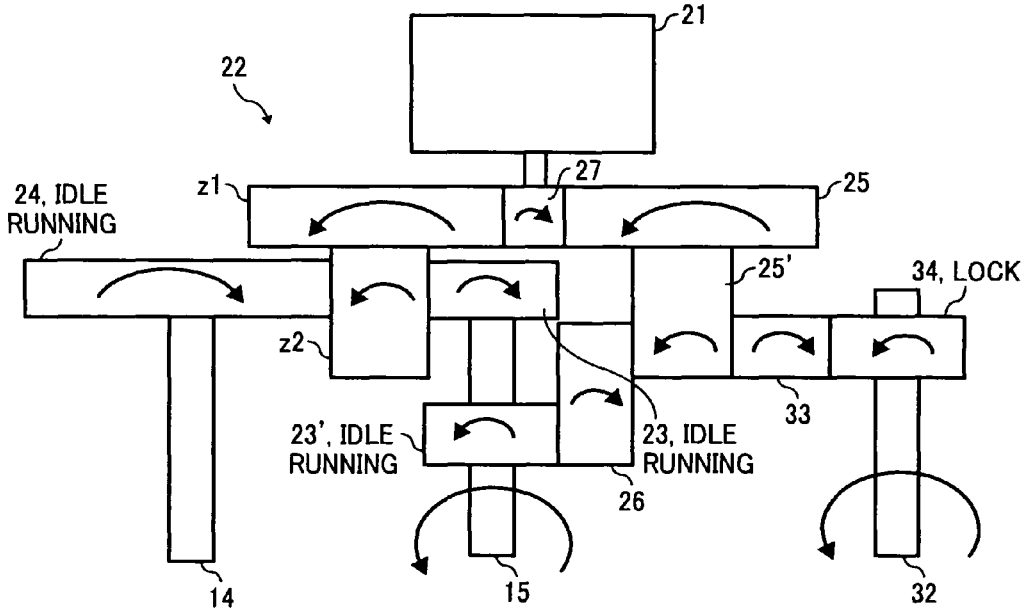
FIG. 21 is a schematic plan view of the sheet-feeding driving unit that drives the sheet feeding device having the relay conveying unit in FIG. 20, when the motor rotates reversely.

FIG. 20 is a schematic plan view of the sheet-feeding driving unit that drives the sheet feeding device equipped with a relay conveying unit having the mechanical drive-blocking mechanism in the driving sequence, when the motor rotates normally. FIG. 21 is a schematic plan view of the sheet-feeding driving unit that drives the sheet feeding device having the relay conveying unit in FIG. 20, when the motor rotates reversely.

The structures in FIGS. 20 and 21 are same as the structures in FIGS. 17 and 18. Therefore, the same numeral references are attached to the same portions, and an explanation on unnecessary configuration or motion will be omitted. In the structures, when there is no torque margin that drives three rollers 14, 15, and 32 at the time of normal rotation of the motor, the one-way clutch is employed in the gear 34 as shown in FIGS. 20 and 21.

When the motor rotates normally, the sheet feeding roller 14 and the conveying roller 15 are driven. When the motor rotates reversely, the conveying roller 15 and the relay conveying roller 32 are driven. As a result, two rollers are allowed to rotate at any time, whereby the load torque, which is put on the motor, can be reduced.

Roller outer diameters of the conveying roller 15 and the relay conveying roller 32 are made be same, and further, the deduction ratios thereof made be same, whereby the convey-speed is enabled to be stabilized and cost reduction resulting from sharing parts is allowed.

According to some aspects of the present invention, the driving source does not arrange an electrical drive-blocking mechanism such as an electromagnetic clutch in the driving sequence of a feeding unit, a conveying unit, and a registration unit. Therefore, a defect such as a sliding or a corotation in the electromagnetic clutch can be resolved, and a stable sheet conveying ability is allowed to be maintained at any time. The reduction ratios of the two-system driving sequences of the conveying unit are made same, whereby it is possible to try to maintain the stable torque of the driving source (motor), to simplify a control table, and to equalize a conveying speed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image forming unit that forms a toner image on a photosensitive element;

a transfer unit that transfers the toner image formed on the photosensitive element onto a recording medium;

a fixing unit that fixes the toner image transferred onto the recording medium;

a feeding unit that feeds the recording medium one by one;

a conveying unit that is provided at a downstream side of the feeding unit and that conveys the recording medium to the transfer unit;

a registration unit that is provided at a downstream side of the conveying unit and that changes a timing at which the recording medium is fed to the transfer unit;

a driving unit that drives the feeding unit, the conveying unit, and the registration unit; and a common driving source that transmits a drive force to the driving unit that drives the feeding unit and the conveying unit, wherein the driving source is a motor that rotates in either of a normal direction and a reverse direction, the feeding unit includes a mechanical drive-blocking mechanism in its driving sequence, the conveying unit includes a two-system driving sequence and a mechanical drive-blocking mechanism in the driving sequence so as to rotate in one direction regardless of a rotating direction of the driving source, and a reduction ratio of each driving sequence in the conveying unit is identical.

2. The image forming apparatus according to claim 1, wherein the driving source includes an output unit that engages with at least one of the driving sequences including the mechanical drive-blocking mechanism.

3. The image forming apparatus according to claim 1, wherein the driving source of the feeding unit and the conveying unit includes an output unit that engages with at least one of the driving sequences including the mechanical drive-blocking mechanism, and a mechanical drive-blocking mechanism is further provided at a final stage of the feeding unit.

4. The image forming apparatus according to claim 1, wherein the driving source includes an output unit, and all of the driving sequences that engage with the output unit of the driving source include the mechanical drive-blocking mechanism.

5. The image forming apparatus according to claim 1, wherein conveying speeds of the feeding unit and the conveying unit until a tip of the recording medium fed from the feeding unit reaches the registration unit is faster than a conveying speed after the tip of the recording medium has reached the registration unit.

6. The image forming apparatus according to claim 1, further comprising:

a manual feeding unit that manually feeds the recording medium one by one; and a driving unit that includes an independent driving source for driving the manual feeding unit, wherein the conveying unit is arranged at a downstream of the recording medium fed from the manual feeding unit.

7. The image forming apparatus according to claim 6, wherein the driving unit that drives the feeding unit and the conveying unit is engaged with at least one of the driving sequences having the mechanical drive-blocking mechanism with a same driving source, and the mechanical drive-blocking mechanism is arranged at a final stage of the feeding unit.

8. The image forming apparatus according to claim 6, wherein the driving source of the feeding unit and the conveying unit includes an output unit, and all of the driving sequences that engage with the output unit of the driving source of the feeding unit and the conveying unit include the mechanical drive-blocking mechanism.

9. The image forming apparatus according to claim 6, wherein a conveying speed of the manual feeding unit and the conveying unit until a tip of the recording medium fed from the manual feeding unit reaches the registration unit is faster than a conveying speed after the tip of the recording medium has reached the registration unit.

10. The image forming apparatus according to claim 6, wherein the driving source of the feeding unit, the conveying unit, and the manual feeding unit is a permanent-magnet-type stepping motor.

11. The image forming apparatus according to claim 1, wherein the feeding unit and the conveying unit have a separating mechanism.

12. The image forming apparatus according to claim 11, wherein the separating mechanism is a friction pad.

13. The image forming apparatus according to claim 1, wherein the mechanical drive-blocking mechanism is a one-way clutch.

14. The image forming apparatus according to claim 1, wherein the image forming apparatus is a four-drum tandem-type full-color image forming apparatus.

15. The image forming apparatus according to claim 1, wherein the feeding unit is provided in a plurality of stages, the image forming apparatus further comprises a relay conveying unit arranged between a lower-stage feeding unit and an upper-stage feeding unit, and the relay conveying unit is driven by a driving source of the upper-stage feeding unit.

16. The image forming apparatus according to claim 15, wherein the relay conveying unit includes a mechanical drive-blocking mechanism in the driving sequence.

17. The image forming apparatus according to claim 15, wherein an outer diameter of the conveying unit is same as an outer diameter of the relay conveying unit, and reduction ratios of driving sequences of the conveying unit and the relay conveying unit are identical.

* * * * *